US012324457B1

(12) United States Patent
Chen

(10) Patent No.: US 12,324,457 B1
(45) Date of Patent: Jun. 10, 2025

(54) ELECTRONIC ATOMIZER WITH SMOKE ELIMINATION FUNCTION

(71) Applicant: Shenzhen Impetus Technology Co., Ltd., Guangdong (CN)

(72) Inventor: Liqian Chen, Guangdong (CN)

(73) Assignee: Shenzhen Impetus Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/916,733

(22) Filed: Oct. 16, 2024

(30) Foreign Application Priority Data

Aug. 30, 2024 (CN) ..... 202422138474.4

(51) Int. Cl.
*A24D 3/17* (2020.01)
*A24F 40/485* (2020.01)

(52) U.S. Cl.
CPC ..... *A24D 3/17* (2020.01); *A24F 40/485* (2020.01)

(58) Field of Classification Search
CPC ..... A24F 40/485; A24F 40/40
See application file for complete search history.

(56) References Cited

U.S. PATENT DOCUMENTS 5,495,859 A * 3/1996 Bowen ..... A24F 13/00 131/202
6,113,415 A * 9/2000 Bertsch ..... H01R 13/514 439/701
6,976,887 B2 * 12/2005 Shigeta ..... H01R 13/514 439/157
9,402,422 B2 * 8/2016 Shenkal ..... H05B 3/40
10,786,001 B2 * 9/2020 Prog ..... A24D 3/04

* cited by examiner

*Primary Examiner* — Hae Moon Hyeon

(57) ABSTRACT

The disclosure provides an electronic atomizer with smoke elimination function, comprising: an atomization mechanism, wherein the atomization mechanism is equipped with a mouthpiece, allowing the smoke generated by the atomization mechanism to be drawn through the mouthpiece; and a smoke elimination mechanism, including a smoke elimination housing and a smoke filtration structure disposed within the smoke elimination housing. The smoke elimination housing is connected to the atomization mechanism, and is equipped with a smoke blowing hole and an air outlet hole respectively. The smoke blowing hole is arranged corresponding to one end of the smoke filtration structure, while the air outlet hole is arranged corresponding to the other end of the smoke filtration structure, such that the smoke entering through the smoke blowing hole is filtered by the smoke filtration structure and then discharged from the air outlet hole.

5 Claims, 4 Drawing Sheets

ELECTRONIC ATOMIZER WITH SMOKE ELIMINATION FUNCTION

CROSS REFERENCE TO RELATED APPLICATIONS

This non-provisional patent application claims priority under 35 U.S.C. § 119 from Chinese Patent Application No. 202422138474.4 filed on Aug. 30, 2024, the entire content of which is incorporated herein by reference.

TECHNICAL FIELD

The disclosure belongs to electronic atomizers technologies, and more specifically, relates to an electronic atomizer with a smoke elimination function.

BACKGROUND

An electronic atomizer (or e-cigarette) is a device that generates smoke by heating chemicals or other substances, creating an inhalable vapor which is then inhaled by user. After inhalation, the user exhales the vapor. While exhaled vapor from the e-cigarette generally contains fewer harmful substances than cigarette smoke, it may still have some impact on bystanders. Consequently, the use of the electronic atomizer is often restricted or prohibited in many public areas dues to concerns about public health and social norms.

SUMMARY

The disclosure provides an electronic atomizer with smoke elimination function, comprising: an atomization mechanism, wherein the atomization mechanism is equipped with a mouthpiece, allowing the smoke generated by the atomization mechanism to be drawn through the mouthpiece; and a smoke elimination mechanism, including a smoke elimination housing and a smoke filtration structure disposed within the smoke elimination housing. The smoke elimination housing is connected to the atomization mechanism, and is equipped with a smoke blowing hole and an air outlet hole respectively. The smoke blowing hole is arranged corresponding to one end of the smoke filtration structure, while the air outlet hole is arranged corresponding to the other end of the smoke filtration structure, such that the smoke entering through the smoke blowing hole is filtered by the smoke filtration structure and then discharged from the air outlet hole. In other words, the electronic atomizer of the present application is equipped with the function of smoke elimination, allowing it to be used in a wider range of environments.

INVENTION CONTENTS

An electronic atomizer with a smoke elimination function, addressing the technical issues mentioned in the background art.

A smoke elimination mechanism, including a smoke elimination housing and a smoke filtration structure disposed within the smoke elimination housing. The smoke elimination housing is connected to the atomization mechanism defines a smoke blowing hole, and an air outlet hole respectively. The smoke blowing hole is arranged corresponding to one end of the smoke filtration structure, while the air outlet hole is arranged corresponding to the other end of the smoke filtration structure, such that the smoke entering through the smoke blowing hole is filtered by the smoke filtration structure and then discharged from the air outlet hole.

In other words, in the electronic atomizer of the disclosure, by connecting a smoke elimination mechanism with a smoke inlet hole and an air outlet hole to the atomization mechanism, after the user inhales the smoke generated by the atomization mechanism, they can blow the smoke back into the smoke elimination mechanism through the smoke inlet hole. The smoke elimination mechanism filters the smoke particles in the smoke and discharges the resulting gas from the air outlet hole, thereby achieving the purpose of smoke elimination and enabling the electronic atomizer to be used in more environments.

Furthermore, the smoke elimination housing is arranged at an end of the atomization mechanism away from the mouthpiece:

Furthermore, a gap is formed between the smoke elimination housing and the atomization mechanism, and the gap is communicated with the air inlet hole of the atomization mechanism.

Furthermore, the smoke elimination housing is detachably connected to the atomization mechanism.

Furthermore, a limiting slide groove is defined on the atomization mechanism, and the limiting slide groove extends to form an opening. A first retaining portion is mounted in the limiting slide groove. A sliding block is mounted on the smoke elimination housing, and a second retaining portion is disposed on the sliding block. The sliding block is slidably coup to the limiting slide groove through the opening, and the first retaining portion and the second retaining portion are engaged with each other. The limiting slide groove restricts the sliding block in a direction perpendicular to a sliding direction of the sliding block, while the first retaining portion and the second retaining portion restrict the sliding block in the sliding direction of the sliding block.

Furthermore, the smoke blowing hole is arranged at an end of the smoke elimination housing away from the atomization mechanism, and the air outlet hole is arranged at an end of the smoke elimination housing close to the atomization mechanism.

Furthermore, the smoke blowing hole is located on an end surface of the smoke elimination housing, and the air outlet hole is located on a sidewall of the smoke elimination housing.

Furthermore, the smoke filtration structure includes a smoke filter element disposed within the smoke elimination housing, and at least a portion of the smoke filter element is capable of covering the smoke blowing hole, such that all smoke entering through the smoke blowing hole passes through the smoke filter element.

Furthermore, the smoke filtration structure also includes a Smoke deflector with multiple smoke passage holes. The Smoke deflector is arranged at the end of the smoke filter element close to the smoke blowing hole, and covers the smoke blowing hole: the Smoke deflector also covers the end surface of the smoke filter element close to the smoke blowing hole.

Furthermore, the smoke filtration structure further includes a smoke filter housing disposed within the smoke elimination housing. The smoke filter housing defines a through-cavity, and the smoke filter element is disposed within the through-cavity, with the smoke filter element in close contact with the sidewalls of the through-cavity. A sealing member is also included, disposed between the smoke filter housing and the end of the smoke elimination housing where the smoke blowing hole is located. The sealing member directs the smoke entering through the smoke blowing hole into the smoke filter housing. The smoke deflector is located between the sealing member and the end of the smoke elimination housing where the smoke blowing hole is located.

Furthermore, the smoke filter element is made of nano-scale filtration material.

BRIEF DESCRIPTION OF THE DRAWINGS

To more clearly illustrate the technical solutions in the embodiments of the disclosure, the following is a brief introduction to the drawings required for the description of the embodiments or prior art. It is apparent that the drawings in the following descriptions are merely some embodiments of the disclosure. For ordinary technicians in the field, other drawings can be obtained based on these drawings without creative efforts.

REFERENCE NUMERALS

100, Atomization Mechanism; 110, Mouthpiece; 120, Air Inlet; 130, Atomization housing; 140, Limiting Slide Groove; 150, First Retaining Portion; 200, Smoke Elimination Mechanism; 210, Smoke Elimination housing; 220, Smoke Filtration Structure; 221, Smoke Filter Element; 222, Smoke Deflector; 223, Smoke Filter Housing; 224, Seal; 230, Smoke Blowing Hole; 240, Air Outlet; 250, Sliding Block; 260, Second Retaining Portion.

DETAILED DESCRIPTION OF THE EMBODIMENTS

In order to make the technical problems, technical solutions, and beneficial effects addressed by this utility model clearer and more comprehensible, further detailed explanations are provided below in conjunction with the accompanying drawings and embodiments. It should be understood that the specific embodiments described herein are merely used to explain the utility model and do not limit it.

It should be noted that when an element is referred to as being "fixed to" or "disposed on" another element, it can be either directly on the other element or indirectly thereon. When an element is referred to as being "connected to" another element, it can be either directly connected to the other element or indirectly connected thereto.

It is important to understand that terms such as "length", "width", "up", "down", "front", "rear", "left", "right", "vertical", "horizontal", "top", "bottom", "inner", "outer", and other indications of orientation or positional relationships are based on the orientation or positional relationships shown in the accompanying drawings. These are solely for the purpose of facilitating the description of the utility model and simplifying it, and do not indicate or imply that the device or element being referred to must have a specific orientation, be configured or operated in a specific orientation. Therefore, they cannot be construed as limitations on the utility model.

Additionally, the terms "first" and "second" are used for descriptive purposes only and are not to be construed as indicating or implying relative importance or implicitly specifying the number of technical features indicated. Thus, features qualified with "first" and "second" may explicitly or implicitly include one or more of those features. In some descriptions of the utility model, "plurality" means two or more, unless otherwise specifically and explicitly limited.

Figure 1:
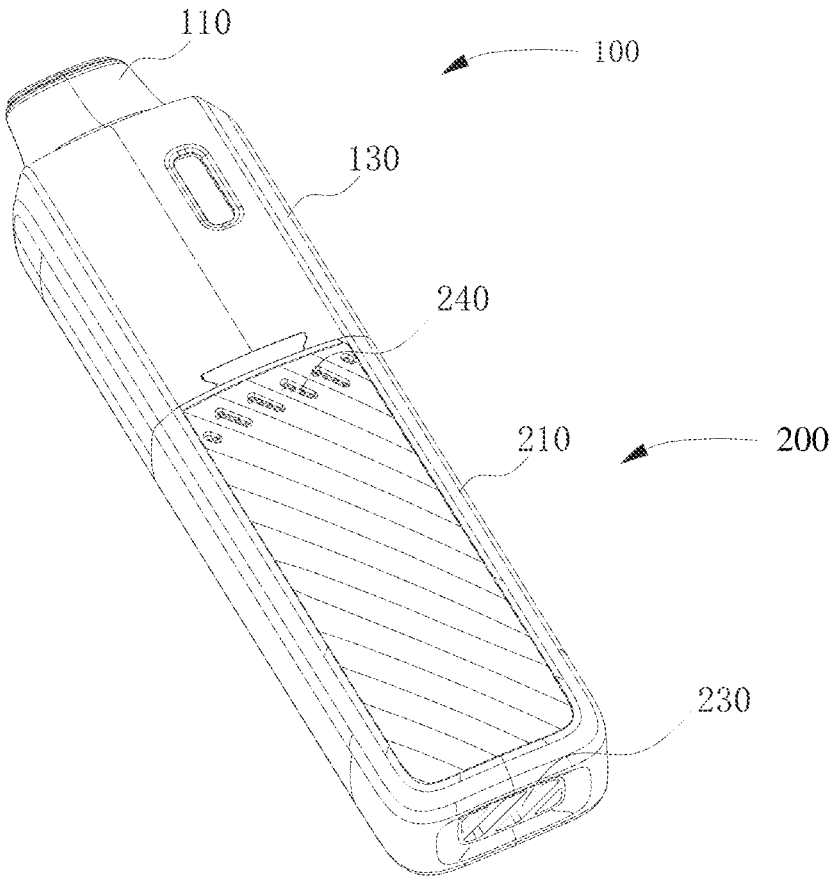
FIG. 1 is a structural diagram of an electronic atomizer with smoke elimination function provided by the disclosure.

Referring to FIG. 1, an electronic atomizer with a smoke elimination function, including an atomizing mechanism 100, and a smoke elimination mechanism 200. The atomizing mechanism 100 is configured to generate smoke that can be inhaled by a user, while the smoke elimination mechanism 200 is configured to eliminate the smoke exhaled by the user after inhalation.

Furthermore, the atomizing mechanism 100 has a mouthpiece 110, through which the smoke generated by the atomizing mechanism 100 can be inhaled. Specifically, in some embodiments, the atomizing mechanism 100 can atomize e-liquid, tobacco paste, or tobacco leaves to generate smoke, which can then be inhaled by the user through the mouthpiece 110.

It should be noted that the generation of smoke through atomization of e-liquid, tobacco paste, or tobacco leaves by the atomizing mechanism 100 is prior art. For example, in addition to the mouthpiece 110, the atomizing mechanism 100 may also include a power supply, an air inlet hole 120 disposed on the atomization housing 130, an atomizing core (i.e., a component used to heat e-liquid, tobacco paste, or tobacco leaves to generate smoke), etc. The power supply (such as a battery) supplies power to the atomizing core, which heats the e-liquid, tobacco paste, or tobacco leaves to generate smoke. The smoke is then inhaled by the user through the mouthpiece 110 via an airway within the atomizing mechanism 100. This process will not be elaborated further here.

The smoke elimination mechanism 200 includes a smoke elimination housing 210, and a smoke filtration structure 220 disposed within the smoke elimination housing 210. The smoke elimination housing 210 is connected to the atomizing mechanism 100, and defines a smoke blowing hole 230 and an air outlet hole 240, respectively. The smoke blowing hole 230 is arranged corresponding to one end of the smoke filtration structure 220, and the air outlet hole 240 is arranged corresponding to the other end of the smoke filtration structure 220, such that smoke entering through the smoke blowing hole 230 is filtered by the smoke filtration structure 220 and then discharged from the air outlet hole 240.

In use, after inhaling the smoke generated by the atomizing mechanism 100 through the mouthpiece 110, the user aligns their mouth with the smoke blowing hole 230 to blow the smoke in their mouth into the smoke elimination housing 210 through the smoke blowing hole 230. Subsequently, the smoke within the smoke elimination housing 210 passes through the smoke filtration structure 220, where smoke particles are filtered out, leaving only gas without the smoke particles to be discharged from the air outlet hole 240, thereby achieving the purpose of smoke elimination.

In other words, in the electronic atomizer, by connecting the smoke elimination mechanism 200 with a smoke blowing hole 230 and the air outlet holes 240 to the atomizing mechanism 100, after inhaling the smoke generated by the atomizing mechanism 100, the user can blow the smoke back into the smoke elimination mechanism 200 through the smoke blowing hole 230. The smoke elimination mechanism 200 then filters out the smoke particles from the smoke and discharges the resulting gas from the air outlet hole 240, thereby achieving the purpose of smoke elimination and endowing the electronic atomizer with the smoke elimination function, this can further enable the electronic atomizer to be use in more environments.

Furthermore, in some embodiments, to facilitate the use of the electronic atomizer while maintaining a similar form factor to existing electronic atomizers and avoiding interference with the user's inhalation of smoke through the mouthpiece 110, the smoke elimination housing 210 may be disposed at an end of the atomizing mechanism 100 away from the mouthpiece 110. Optionally, a gap is formed between the smoke elimination housing 210 and the atomizing mechanism 100, with the gap communicating with the air inlet hole 120 of the atomizing mechanism 100. This allows outside air to flows into the air inlet hole 120 of the atomizing mechanism 100 through the gap, and this arrangement also conceals the air inlet hole 120 between the smoke elimination housing 210 and the atomizing mechanism 100.

Additionally, the smoke elimination housing 210 and the atomizing mechanism 100 are detachably connected to facilitate the replacement of either the atomizing mechanism 100 or the smoke elimination mechanism 200.

In some embodiments, the atomization mechanism 100 can adopt a disposable design, indicating that no additional substances such as e-liquid can be replenished during use for atomization to produce smoke. Once the e-liquid or other substances within the atomization mechanism 100 are depleted, the atomization mechanism 100 can be detached from the smoke elimination mechanism 200, replaced with a new atomization mechanism 100, and the same smoke elimination mechanism 200 can continue to be used.

Similarly, when an excessive amount of the smoke particles accumulates in the smoke filtration structure 220 within the smoke elimination mechanism 200, this negatively impact both the efficiency and effectiveness of the smoke elimination process. At this point, the smoke elimination mechanism 200 can also be detached from the atomization mechanism 100, replaced with a new smoke elimination mechanism 200.

Specifically, in some embodiments, the atomization mechanism 100 further defines a limiting slide groove 140, for example, on the atomization housing 130 of the atomization mechanism 100. The limiting slide groove 140 extends to form an opening, and a first retaining portion 150 is disposed on the limiting slide groove 140.

A sliding block 250 is disposed on the smoke elimination housing 210, and a second retaining portion 260 is disposed on the sliding block 250. The sliding block 250 is slidably mounted within the limiting slide groove 140 via the opening, enabling the first retaining portion 150 and the second retaining portion 260 to engage with each other. The limiting slide groove 140 restricts the sliding block 250 in a direction perpendicular to the sliding direction of the sliding block 250, while the first retaining portion 150 and the second retaining portion 260 restrict the sliding block 250 in the sliding direction of the sliding block 250.

For instance, the first retaining portion 150 is an elastic protrusion disposed within the limiting slide groove 140, specifically an elastic protrusion with an arc-shaped structure that can undergo elastic displacement when compressed.

The second retaining portion 260 can be a retaining groove disposed on the sliding block 250. When the elastic protrusion is located within the retaining groove, displacement in the sliding direction of the sliding block 250 is achieved.

During use, the smoke elimination mechanism 200 is inserted into the limiting slide groove 140 via the opening using the sliding block 250. During insertion, the first retaining portion 150 is compressed to undergo elastic displacement. Once the sliding block 250 slides into the limiting slide groove 140, the first retaining portion 150 and the second retaining portion 260 engage with each other. At this point, the limiting slide groove 140 restricts the sliding block 250 in a direction perpendicular to the sliding direction of the sliding block 250, while the first retaining portion 150 and the second retaining portion 260 restrict the sliding block 250 in the sliding direction of the sliding block 250, realizing the connection between the smoke elimination mechanism 200 and the atomization mechanism 100.

Of course, in other embodiments, a magnetic attraction method can also be used to achieve a detachable connection between the atomization mechanism 100 and the smoke elimination mechanism 200.

Referring to FIG. 1, in some embodiments, to facilitate user blowing smoke from their mouths into the smoke elimination housing 210 through the smoke blowing hole 230 and ensure that the smoke entering the smoke elimination housing 210 can be fully filtered by the smoke filtration structure 220, the smoke blowing hole 230 is positioned at an end of the smoke elimination housing 210 away from the atomization mechanism 100, while the air outlet hole 240 is positioned at an end of the smoke elimination housing 210 close to the atomization mechanism 100.

Specifically, the smoke blowing hole 230 is located on an end surface of the smoke elimination housing 210, and the air outlet hole 240 is located on a sidewall of the smoke elimination housing 210.

It is understandable that positioning the smoke blowing hole 230 on the end surface of the smoke elimination housing 210 facilitates user to blow into the smoke blowing hole 230 with their mouths, for example, by pressing their lips against the smoke blowing hole 230. Positioning the air outlet hole 240 on the side of the smoke elimination housing 210 facilitates the discharge of gas without being obstructed by the electronic atomizer.

Figure 2:
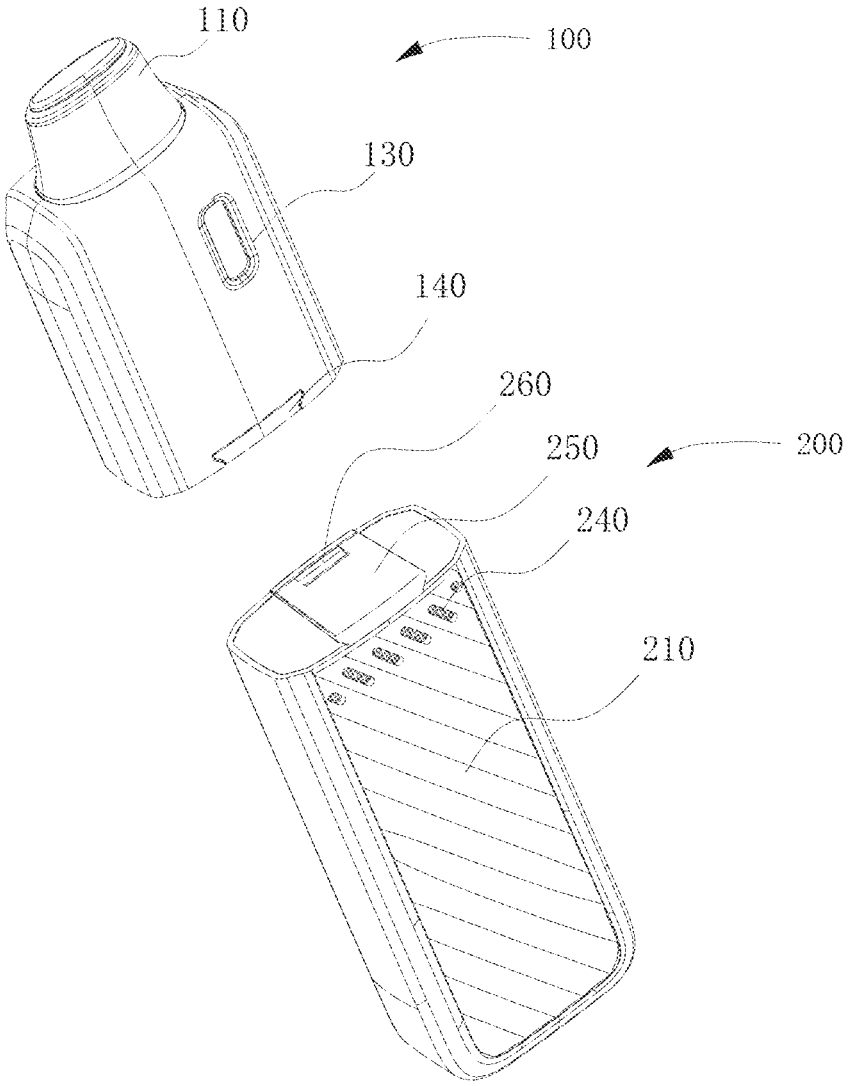
FIG. 2 is an exploded diagram of an electronic atomizer with smoke elimination function provided by the disclosure.

Referring to FIG. 2, the smoke filtration structure 220 includes a smoke filter element 221 disposed within the smoke elimination housing 210. The smoke filter element 221 is capable of at least covering the smoke blowing hole 230, ensuring that all smoke entering through the smoke blowing hole 230 passes through the smoke filter element 221, thereby guaranteeing the efficiency and effectiveness of smoke filtration.

It should be noted that the statement that the smoke filter element 221 is capability of the smoke filter element 221 to at least cover the smoke blowing hole 230 specifically refers to the projection or extension of the smoke filter element 221 towards the smoke blowing hole 230 being sufficient to cover the smoke blowing hole 230 at least partially. In this approach, the smoke filter element 221 can either be in contact with the smoke blowing hole 230 or maintain a certain distance from the smoke blowing hole 230.

Additionally, in some embodiments, the smoke filter element 221 is made of nanoscale filtration materials to filter nanoscale particles in smoke, thereby achieving smoke elimination. For example, the smoke filter element 221 is also made of high-density H13 glass fiber material.

Furthermore, the smoke filtration structure 220 can also include a smoke deflector 222, which defines a plurality of smoke passage holes. The smoke deflector 222 is positioned at an end of the smoke filter element 221 close to the smoke blowing hole 230 and covers the smoke blowing hole 230. The smoke deflector 222 serves to deflect the smoke blown into the smoke filter element 221.by the user, enabling the smoke to flow uniformly through the smoke filter element 221.

It is understandable that user need to blow smoke into the smoke blowing hole 230 with their mouths, so the smoke is blown into the atomization housing 130 as a fast airflow. This results in only the area of the smoke filter element 221 through which the airflow flows being able to filter the smoke, while other areas of the smoke filter element 221 cannot, reducing its utilization rate and affecting the lifespan of the smoke elimination mechanism 200 as well as the effectiveness of smoke filtration. Therefore, by installing the smoke deflector 222, the smoke blown into the smoke blowing hole 230 by the user can be deflected, enabling the smoke to flow uniformly through the smoke filter element 221, thereby solving the aforementioned issues.

During use, when the user blows smoke into the smoke blowing hole 230, the limited quantity of the smoke particles that can pass through each smoke passage hole of the smoke deflector 222 at a time causes the smoke blown in by the user to disperse at the smoke deflector 222, uniformly passing through each smoke passage hole of the smoke deflector 222, thereby achieving the purpose of deflection.

Furthermore, the smoke deflector 222 also covers the end surface of the smoke deflector 222 close to the smoke blowing hole 230, ensuring that the deflected smoke can uniformly enter each area of the smoke filter element 221.

It should be noted that the statement that the smoke deflector 222 covers the end surface of the smoke filter element 221 close to the smoke blowing hole 230 specifically refers to the projection of the smoke deflector 222 towards the smoke filter element 221 being able to at least cover the smoke filter element 221. In this approach, the smoke filter element 221 can either be in contact with the smoke deflector 222 or maintain a certain distance from it.

Figure 3:
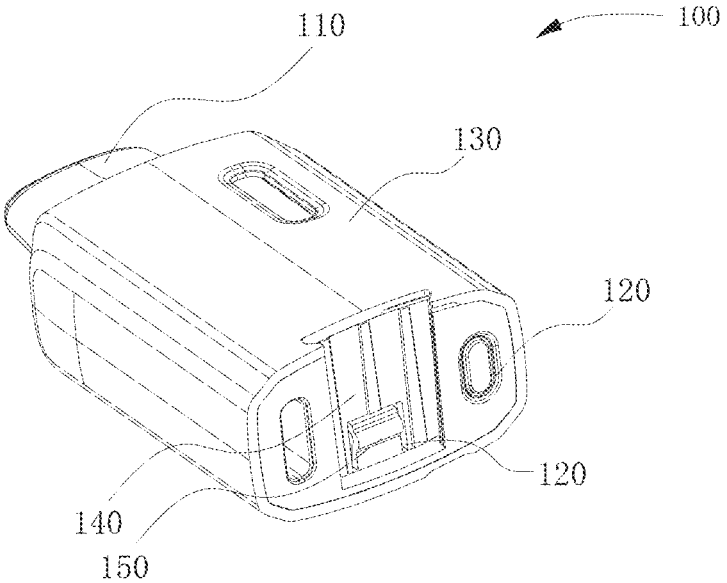
FIG. 3 is a structural diagram of an atomization mechanism in an electronic atomizer with smoke elimination function provided by the disclosure.
Figure 4:
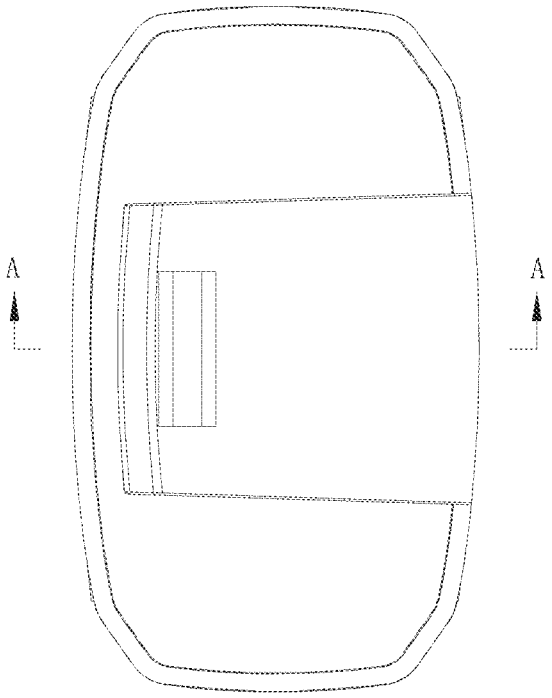
FIG. 4 is a top view diagram of an electronic atomizer with smoke elimination function provided by the disclosure.
Figure 5:
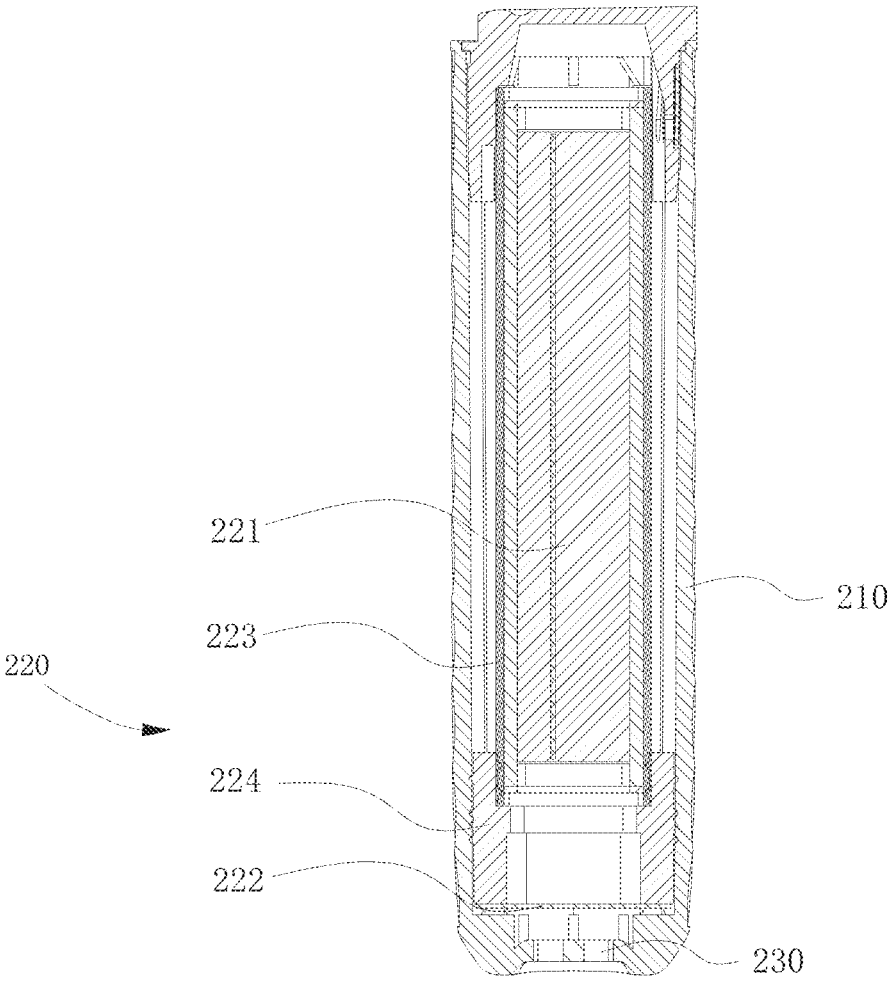
FIG. 5 is a sectional view of section A-A in FIG. 4.

Referring to FIG. 3, in some embodiments, to better ensure that all smoke blown in by the user is filtered by the smoke filter element 221, the smoke filtration structure 220 can also include a smoke filter housing 223 disposed within the smoke elimination housing 210. The smoke filter housing 223 has a through-cavity, and the smoke filter element 221 is disposed within the through-cavity, with the smoke filter element 221 in close contact with sidewalls of the through-cavity to ensure that all smoke entering the smoke filter housing 223 is filtered by the smoke filter element 221, thereby guaranteeing the effectiveness of filtration.

Furthermore, the smoke filtration structure 220 also includes a sealing member 224, which is disposed between the smoke filter housing 223 and the end of the smoke elimination housing 210 where the smoke blowing hole 230 is located. The sealing member 224 is used to guide the smoke entering through the smoke blowing hole 230 into the smoke filter housing 223, ensuring that all smoke blown through the smoke blowing hole 230 can enter the smoke filter housing 223. Wherein, the sealing member 224 can be an annular structure made of materials such as silicone, which are commonly used for sealing connections.

Additionally, when the smoke filtration structure 220 includes the sealing member 224, the smoke deflector 222 can be positioned between the sealing member 224 and the end of the smoke elimination housing 210 where the smoke blowing hole 230 is located. In other words, after entering through the smoke blowing hole 230, the smoke is guided by the smoke deflector 222 and then evenly enters the Smoke Filter Housing 223 to be filtered by the smoke filter element 221.

Certainly, in some embodiments, the smoke deflector 222 can also be arranged between the smoke elimination housing 210 and the sealing member 224.

The above are merely preferred embodiments of the disclosure and are not intended to limit it. Any modifications, equivalent replacements, and improvements made within the spirit and principles of the disclosure should be deemed as falling within the scope of protection of the disclosure.

The invention claimed is:

1. An electronic atomizer with a smoke elimination function, comprising:

an atomization mechanism, with a mouthpiece, allowing for inhalation of smoke generated by the atomization mechanism through the mouthpiece; and a smoke elimination mechanism, including a smoke elimination housing, and, a smoke filtration structure disposed within the smoke elimination housing and connected to the smoke elimination housing; the smoke elimination housing defining a smoke blowing hole, and an air outlet hole, respectively disposed corresponding two opposite ends of the smoke filtration structure such that the smoke entering through the smoke blowing hole is filtered by the smoke filtration structure and then discharged from the air outlet hole;

wherein the smoke elimination housing is disposed at an end of the atomization mechanism far away from the mouthpiece; a gap is defined between the smoke elimination housing and the atomization mechanism, and the gap is communicated to an air inlet hole of the atomization mechanism;

wherein the smoke elimination housing is detachably connected to the atomization mechanism;

wherein a limiting slide groove is defined on the atomization mechanism, and the limiting slide groove extends to form an opening, with a first retaining portion disposed on the limiting slide groove; a sliding block is disposed in the smoke elimination housing, and a second retaining portion is disposed on the sliding block; the sliding block is slidably connected within the limiting slide groove via the opening, enabling the first retaining portion and the second retaining portion to engage with each other, the limiting slide groove restricts the sliding block in a direction perpendicular to a sliding direction of the sliding block, and the first retaining portion and the second retaining portion restrict the sliding block in the sliding direction of the sliding block;

wherein the smoke filtration structure includes a smoke filter element disposed within the smoke elimination housing, and the smoke filter element is at least covering the smoke blowing hole, such that all smoke entering through the smoke blowing hole can pass through the smoke filter element;

wherein the smoke filtration structure further includes a smoke filter housing disposed within the smoke elimination housing, the smoke filter housing having a through-cavity, the smoke filter element is disposed within the through-cavity and in close contact with sidewalls of the through-cavity; a sealing member is also included, disposed between the smoke filter housing and an end of the smoke elimination housing where the smoke blowing hole is located, the sealing member guiding smoke entering through the smoke blowing hole into the smoke filter housing;

the smoke deflector is located between the sealing member and the end of the smoke elimination housing where the smoke blowing hole is located.

2. The electronic atomizer with the smoke elimination function according to claim 1, wherein the smoke blowing hole is disposed at one end of the smoke elimination housing far away from the atomization mechanism, and the air outlet hole is disposed at an end of the smoke elimination housing close to the atomization mechanism.

3. The electronic atomizer with the smoke elimination function according to claim 2, wherein the smoke blowing hole is located on an end surface of the smoke elimination housing, and the air outlet hole is located on a sidewall of the smoke elimination housing.

4. The electronic atomizer with smoke elimination function according to claim 1, wherein the smoke filtration structure further includes a smoke deflector with a plurality of smoke passage holes, the smoke deflector is disposed at an end of the smoke filter element close to the smoke blowing hole, and the smoke deflector covers the smoke blowing hole; the smoke deflector also covers an end surface of the smoke filter element close to the smoke blowing hole.

5. The electronic atomizer with smoke elimination function according to claim 1, wherein the smoke filter element is made of nanoscale filtration materials.

* * * * *